US006138599A

United States Patent [19]

Elson

[11] Patent Number: 6,138,599

[45] **Date of Patent: *Oct. 31, 2000**

[54] BUOYANT WALKWAY MODULE FOR A BOATLIFT

[75] Inventor: Todd A. Elson, Claremore, Okla.

[73] Assignee: Hydrohoist International, Inc., Claremore, Okla.

[ * ] Notice: This patent is subject to a terminal disclaimer.

[21] Appl. No.: 09/368,253

[22] Filed: Aug. 3, 1999

Related U.S. Application Data

[63] Continuation of application No. 08/892,479, Jul. 14, 1997, Pat. No. 5,947,049, which is a continuation of application No. 08/647,191, May 9, 1996, abandoned, which is a continuation of application No. 08/441,125, May 15, 1995, abandoned.

[51] Int. Cl.[7] ..... B63B 35/34

[52] U.S. Cl. ..... 114/263; 114/266

[58] Field of Search ..... 114/263, 266, 114/267, 44, 45, 48; 405/218–220; 14/27

[56] References Cited

U.S. PATENT DOCUMENTS

| | | | |
|---|---|---|---|
| 3,102,503 | 9/1963 | Sheffield | 114/263 |
| 3,977,344 | 8/1976 | Holford | 114/263 |
| 4,043,287 | 8/1977 | Shorter, Jr. | 114/266 |
| 4,848,260 | 7/1989 | Hamilton et al. | 114/266 |
| 5,947,049 | 9/1999 | Elson | 114/263 |

FOREIGN PATENT DOCUMENTS

| | | |
|---|---|---|
| 247189 | 9/1926 | United Kingdom . |

*Primary Examiner*—Ed Swinehart
*Attorney, Agent, or Firm*—Frank J. Catalano

[57] ABSTRACT

A buoyant walkway module for a boatlift is formed from a plurality of pneumatically discrete elongated compartments. Each of the compartments has a substantially flat upper horizontal exterior surface and complementary exterior end surfaces. With the end of one such module in abutment with the complementary end of another such module, the upper horizontal surfaces lie in the same plane so as to provide a suitable walkway for the boatman. Preferably, the end surfaces are perpendicular to the horizontal surface so as to provide maximum stability in the walkway.

With the modules positioned in end-to-end relationship, they are coupled together by a flat plate disposed across the upper exterior surface of their junction and by a pair of straps extending longitudinally across the lower exterior surface at their junction.

4 Claims, 2 Drawing Sheets

BUOYANT WALKWAY MODULE FOR A BOATLIFT

This application is a continuation of application Ser. No. 08/892,479, now U.S. Pat. No. 5,947,049, filed Jul. 14, 1997, which is a continuation of application Ser. No. 08/647,191, filed May 9, 1996; which is a continuation of application Ser. No. 08/441,125, filed May 15, 1995 now abandoned.

BACKGROUND OF THE INVENTION

This invention relates generally to boatlifts and more particularly concerns boatlift walkways.

A pontoon system for supporting a watercraft on a body of water is described in U.S. Pat. No. 4,018,179 issued to Henry A. Rutter and assigned to National Hydrohoist Company. That system is presently manufactured and marketed by the present assignee, Hydrohoist International, Inc., successor of the former assignee. In that system, walkways of rectangular shape and having a series of floats mounted beneath them served dual purposes as a walkway on either side of the boat and also as a support for the lift in its submerged condition. Originally, the walkway's wooden boards extended for a length of approximately 16 to 20 feet. Since the issuance of their patent, the walkways have been modified to consist of a single piece of fiberglass extending 16 to 26 feet. Sidewalls extend downwardly from the walkway and the space defined by sidewalls depending from the walkway is filled with a flotation foam to provide the desired buoyancy.

In either arrangement, the elongated walkway is hinged at its front and rear ends to the main body of the lift. If it is damaged, the entire length of walkway must be removed for repair or replacement. During this time, the boatlift is unusable. Furthermore, if damage to the walkway is sufficient to crack the board or fiberglass all the way through, the separated portions will hinge, permitting the lift to sink when the primary pontoons are filled with water.

In addition to the above problems of inoperability of the lift, the present arrangement has other drawbacks. The walkways must be stored and shipped in their 16 to 26 foot lengths. If damage to a walkway cannot be repaired, the entire walkway must be replaced. Additional time and materials are further required to fill the underside of the fiberglass with buoyant foam or to secure floats under the wooden board. Furthermore, the contour of the walkway is such that, if a watercraft inadvertently makes contact with it from an inopportune direction, it could cause damage to the hull of the watercraft.

It is, therefore, an object of this invention to provide a buoyant walkway for a lift which is modular rather than of single piece construction. It is another object of this invention to provide a buoyant walkway for a lift having pneumatically discrete modules so that damage to a single module is less likely to defeat the flotation feature of the walkway. It is yet another object of this invention to provide a buoyant walkway for a lift which does not require the attachment of flotation materials to achieve buoyancy. A further object of this invention is to provide a buoyant walkway for a lift which will support the lift despite damage to or even removal of a modular component of the walkway.

SUMMARY OF THE INVENTION

In accordance with the invention, a buoyant walkway module for a boatlift is formed from a plurality of pneumatically discrete elongated compartments. Each of the compartments has a substantially flat upper horizontal exterior surface and complementary exterior end surfaces. With the end of one such module in abutment with the complementary end of another such module, the upper horizontal surfaces lie in the same plane so as to provide a suitable walkway for the boatman. Preferably, the end surfaces are perpendicular to the horizontal surface so as to provide maximum stability in the walkway.

With the modules positioned in end-to-end relationship, they are coupled together by a flat plate disposed across the upper exterior surface of their junction and by a pair of straps extending longitudinally across the lower exterior surface at their junction. Preferably, the horizontal exterior surface of the modules is contoured at its end portions to provide a seat for receiving the rectangular plate so that the top face of the plate will lie in the same plane as the horizontal exterior surfaces of the coupled modules. Apertures in the plate receive screws to fasten the plate to the modules. Preferably, the lower exterior surfaces of the modules are also horizontal and the straps are maximally spaced apart. Apertures in the straps receive screws to fasten the straps to the modules.

The upper horizontal surfaces of the modules may be corrugated to increase traction for the boatman. The sidewalls of the modules may be ribbed to provide additional strength. End caps may be provided which are in all respects similar to the modules themselves except that one end of the cap tapers upwardly longitudinally to its upper horizontal exterior surface and is also rounded to facilitate a sliding relationship between the walkway and the hull of a watercraft should the watercraft inadvertently strike the end of the walkway.

BRIEF DESCRIPTION OF THE DRAWINGS

Other objects and advantages of the invention will become apparent upon reading the following detailed description and upon reference to the drawings in which.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Figure 1:
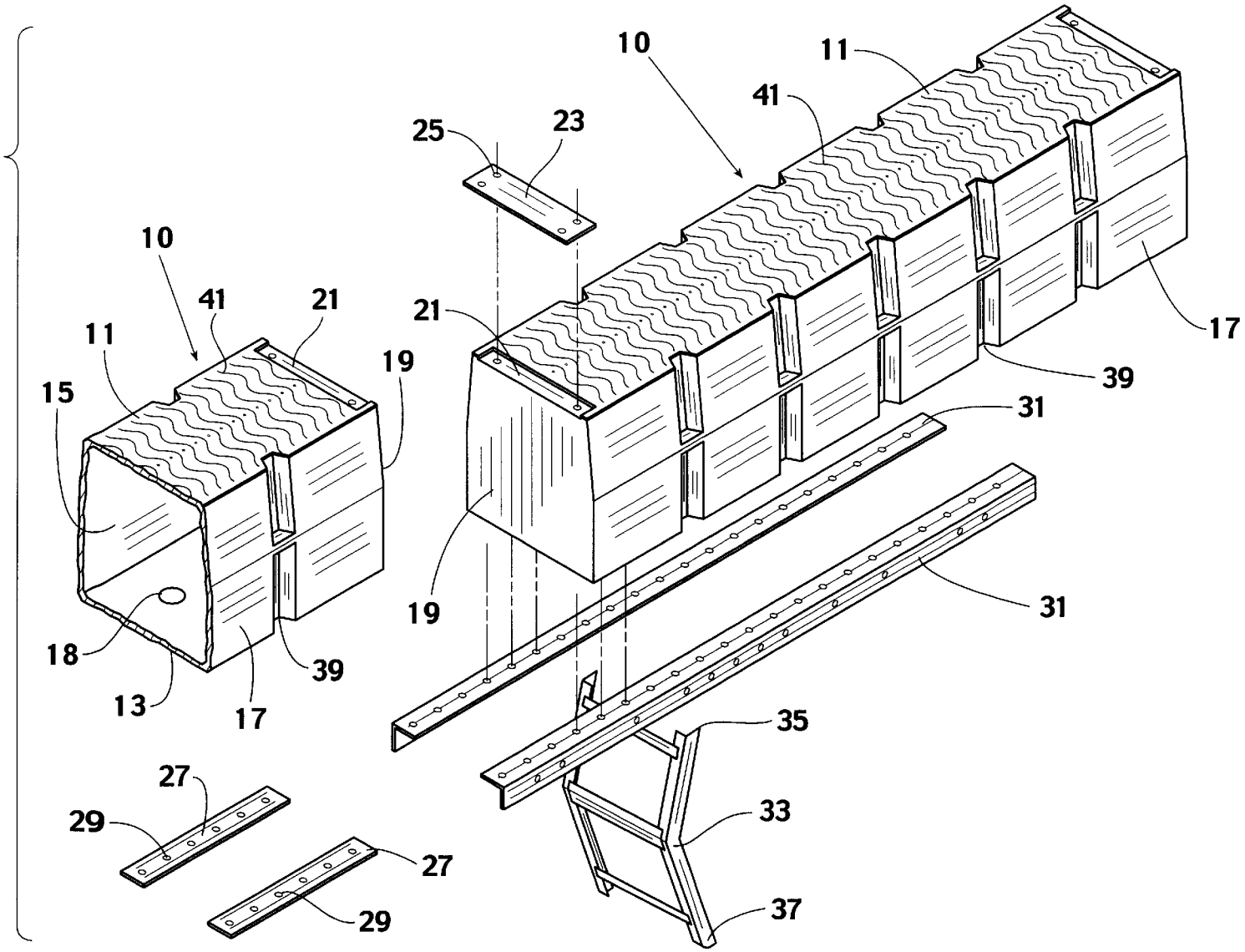
FIG. 1 is a perspective view with parts broken away illustrating the components of the buoyant walkway in a disassembled condition.

Turning first to FIG. 1, buoyant walkway modules 10 are to be assembled into a buoyant walkway for a boatlift. Each module 10 consists of an elongate compartment defined by a substantially flat upper horizontal exterior surface 11 and a substantially flat lower horizontal exterior surface 13 spaced apart by sidewalls 15 and 17 and completed by complementary exterior end surfaces 19. Each module 10 is an independent air containing compartment isolated from other modules 10 in the same boatlift. These modules 10 are therefore said to be pneumatically discrete in that there is no direct pneumatic communication between independent modules. However, this is not to infer that the individual compartments are airtight. Each compartment is preferably formed from an integral segment of molded plastic with a sprue hole in its lowermost surface. Thus, when the module 10 is inserted in the water, the submerged sprue hole traps the air within the module 10 so that buoyancy is not lost.

As shown, the end surfaces 19 are preferably perpendicular to the horizontal surfaces 11. However, any angular relationship could be employed. In addition, while the end surfaces 19 are preferably flat any contour could be employed provided the opposite faces of the modules 10 are complementary. For example, the end faces 19 could be configured in a tongue and groove relationship.

Preferably, the end portions of the horizontal exterior surfaces 11 of each module 10 are provided with seats 21 substantially across the width of the end of the horizontal exterior surface 11. The seats 21 are contoured to receive a plate 23 which will abut the end portions of the upper horizontal exterior surfaces 11 and extend across their junction. As shown, apertures 25 are provided proximate the corners of the rectangular plate 23 to receive screws (not shown) for fastening the plate 23 in its seats 21 on the mated modules 10. A pair of straps 27 are fastened, in preferably maximal spaced apart relationship and in longitudinal alignment, to the lower horizontal surfaces of the modules 10. As shown, each of the straps is provided with a plurality of apertures 29 through which screws may be extended into the lower horizontal surfaces 13 of the modules 10. The straps 27 may be supplemented or replaced by angle irons 31 proximate the front and rear ends of the walkway so as to permit the mounting of a hinge 33 to the downwardly depending portion of the angle iron 31. As shown, the upper ends 35 of the hinge 33 would be connected to the angle irons 31 while the lower ends 37 of the hinge 33 would be connected to the main body of the lift (not shown). Thus, when the primary pontoons (not shown) on the main body of the lift (not shown) are filled with air, the hinge 33 will close and the modules 10 will ride on the main body of the lift. However, when the primary pontoons are permitted to fill with water so as to lower the main body of the lift into the water, the hinge 33 will open to permit the main body of the lift to sink until the hinge 33 is fully opened and the lift is supported by the buoyant walkway modules 10.

As shown, the module sidewalls 15 and 17 will preferably have ribs 39 to provide additional strength to the walkway. Furthermore, the upper horizontal surface 11 may be provided with corrugations 41 to provide additional traction for the boatman. And, while the lower surfaces 13 are preferably flat, this is not required.

Figure 2:
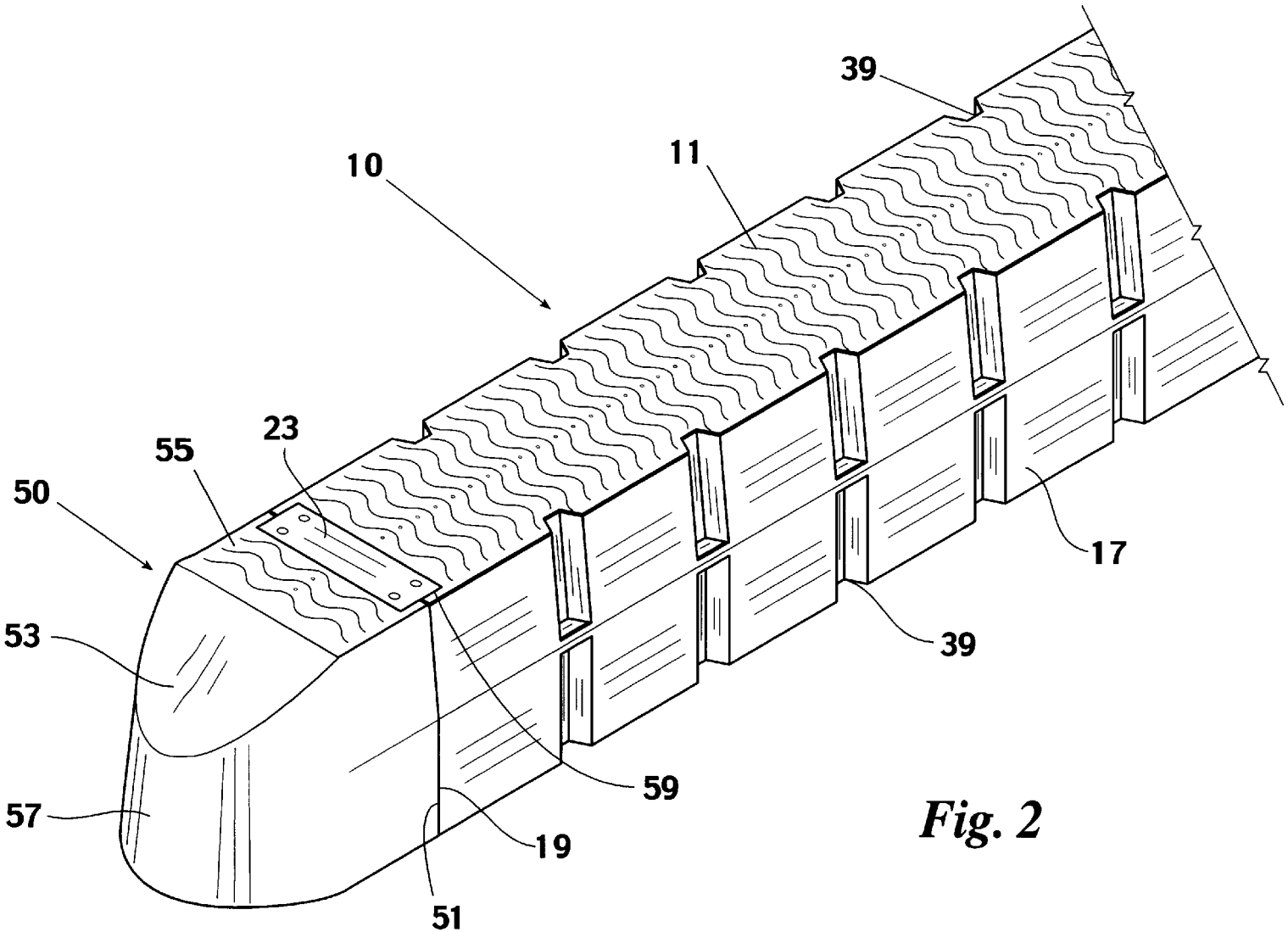
FIG. 2 is a perspective view with parts broken away of an assembled buoyant walkway including an end cap.

Turning now to FIG. 2, a buoyant walkway module 10 is illustrated coupled to a buoyant walkway end cap 50. As shown, the end cap 50 has one end 51 contoured to complement the contour of the end surface 19 of the module 10. The other end surface of the cap 50 includes an upper surface 53 tapering upwardly longitudinally to the upper horizontal exterior surface 55 of the module 50. In addition, the lower end of the end cap 50 will have a lower rounded surface 57. The rounded and tapered contour of the end cap 50 facilitates the sliding of the hull of a watercraft in relation to the end cap 50 so as to minimize the possibility of damage to the hull should a watercraft strike the walkway from an inopportune angle. As shown, the end cap 50 is secured to the module 10 by the use of a plate 23 fastened to the upper faces 11 and 55 of the module 10 and the end cap 50 by screws 59 and by the use of straps 27 along the lower faces of the module 10 and the cap 50 described in relation to FIG. 1.

Preferably, the modules 10 will consist of injection molded, hollow plastic compartments approximately six feet in length, sixteen inches in depth and affording a sixteen inch wide walkway for the boatman. The caps 50 are preferably two to four feet long. While these approximate dimensions are preferable, the dimensions can readily be varied to meet the particular requirements of given applications including the most desirable length of modules, the amount of flotation to be provided by each module and the area of walking surface desired for the boatman.

Thus, it is apparent that there has been provided, in accordance with the invention, a buoyant walkway module for a boatlift that fully satisfies the objects, aims and advantages set forth above. While the invention has been described in conjunction with specific embodiments thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. A buoyant walkway for a boatlift comprising first and second pneumatically discrete elongate compartments in end-to-end abutment, each said compartment having a substantially flat upper horizontal exterior surface and complimentary exterior end surfaces, said upper horizontal surfaces of both said compartments being in a single plane, each end of said substantially flat upper horizontal exterior surface of each said module having a recess therein, a flat plate seated in abutting ones of said recesses with an upper surface in said plane, means fastening said plate to said end portions of said upper horizontal exterior surfaces of said abutting components, a pair of straps spaced apart in longitudinal alignment in abutment with lower exterior horizontal surfaces of said abutting components and means for fastening said straps to said lower exterior horizontal surfaces of said abutting components.

2. A buoyant walkway according to claim 1, said fastening means comprising screws extending through apertures in said straps into said lower exterior horizontal surfaces of said compartments.

3. A buoyant walkway according to claim 1, said straps being spaced substantially maximally apart.

4. A buoyant walkway according to claim 1, said substantially flat upper horizontal surfaces having grooves therein.

* * * * *